US009206685B2

(12) United States Patent
Steinberg et al.

(10) Patent No.: US 9,206,685 B2
(45) Date of Patent: Dec. 8, 2015

(54) APPARATUS FOR THE MILLING CUTTING OF ROCK, MINERALS OR OTHER MATERIALS

(75) Inventors: Jens Steinberg, Lünen (DE); Joachim Raschka, Bochum (DE); Frank Herrmann, Chemnitz (DE); Christian Schreiter, Drebach (DE)

(73) Assignee: Caterpillar Global Mining Europe GmbH, Lünen (DE)

( * ) Notice: Subject to any disclaimer, the term of this patent is extended or adjusted under 35 U.S.C. 154(b) by 0 days.

(21) Appl. No.: 14/116,574

(22) PCT Filed: Apr. 24, 2012

(86) PCT No.: PCT/IB2012/052053

§ 371 (c)(1),
(2), (4) Date: Nov. 21, 2013

(87) PCT Pub. No.: WO2012/156841

PCT Pub. Date: Nov. 22, 2012

(65) Prior Publication Data

US 2014/0232170 A1 Aug. 21, 2014

(30) Foreign Application Priority Data

May 16, 2011 (DE) ..... 20 2011 050 146

(51) Int. Cl.
*E21C 27/24* (2006.01)
*E21D 9/10* (2006.01)
(Continued)

(52) U.S. Cl.
CPC ..... *E21C 27/24* (2013.01); *E21C 25/06* (2013.01); *E21C 27/22* (2013.01); *E21C 35/12* (2013.01); *E21D 9/1026* (2013.01)

(58) Field of Classification Search
CPC ..... E21C 25/06; E21C 27/22; E21C 25/00; E21C 27/24; E21C 35/12; E21C 35/24; E21D 9/1026
USPC ..... 299/36.1, 39.1, 39.5, 42, 48, 49, 50, 53, 299/54, 55, 57, 61, 72, 73, 74, 77, 85.1, 299/80.1
See application file for complete search history.

(56) References Cited

U.S. PATENT DOCUMENTS 2,689,117 A 9/1954 Lindberg
2,730,344 A 1/1956 Cartlidge
(Continued)

FOREIGN PATENT DOCUMENTS

CN 1185508 6/1998
CN 101512101 8/2009
(Continued)

OTHER PUBLICATIONS

International Search Report and Written Opinion for International Application No. PCT/IB2012/052053, dated Mar. 28, 2013, 8 pages.

*Primary Examiner* — Sunil Singh
*Assistant Examiner* — Carib Oquendo

(57) ABSTRACT

A mining apparatus includes two tool drums, which are arranged rotatably side by side in twin arrangement on a drum carrier and which are respectively provided with a plurality of tool carriers which support cutting tools arranged over the periphery of the tool drums and which can be rotatingly driven and the shaft axes of which run substantially transversely to the drum axle. The shaft axes of the tool carriers of the first tool drum span a first conical surface about the drum axis and the shaft axes of the tool carriers of the second tool drum span a second conical surface about the drum axis, where the conical surfaces are open to opposite sides and are preferably oriented such that they are mutually inclined in an O-arrangement.

17 Claims, 3 Drawing Sheets

(51) Int. Cl.

| | |
|---|---|
| ***E21C 27/22*** | (2006.01) |
| ***E21C 35/12*** | (2006.01) |
| ***E21C 25/06*** | (2006.01) |

(56) References Cited

U.S. PATENT DOCUMENTS

| | | | | | |
|---|---|---|---|---|---|
| 2,976,027 | A * | 3/1961 | Allimann | ..... | 299/85.1 |
| 3,074,702 | A * | 1/1963 | Allimann | ..... | 299/85.1 |
| 4,098,539 | A * | 7/1978 | Zitz et al. | ..... | 299/75 |
| 5,924,222 | A | 7/1999 | Stoetzer | | |
| 6,270,163 | B1 * | 8/2001 | Mullet et al. | ..... | 299/75 |
| 6,626,500 | B1 * | 9/2003 | Cribb et al. | ..... | 299/78 |
| 7,604,301 | B1 * | 10/2009 | Lang | ..... | 299/75 |
| 2010/0001574 | A1 * | 1/2010 | Bechem | ..... | 299/10 |

FOREIGN PATENT DOCUMENTS

| | | |
|---|---|---|
| DE | 288 984 | 5/1915 |
| WO | WO 2008/025555 | 3/2008 |

* cited by examiner

APPARATUS FOR THE MILLING CUTTING OF ROCK, MINERALS OR OTHER MATERIALS

CROSS-REFERENCE TO RELATED APPLICATIONS

This application claims the benefit of priority to international patent application number PCT/IB2012/052053, having a filing date of Apr. 24, 2012, which claims the benefit of priority to German patent application number DE202011050146.9, having a filing date of May 16, 2011, the complete disclosures of which are hereby incorporated by reference for all purposes.

TECHNICAL FIELD

The invention relates to an apparatus for the milling cutting of rock, minerals or other, in particular hard, materials, comprising a tool drum mounted on a drum carrier rotatably about a drum axis, and comprising a plurality of tool carriers, which are arranged distributed over the periphery of the tool drum and carry cutting tools and which can be rotatingly driven and the shaft axes of which run transversely to the drum axis.

BACKGROUND

An apparatus of this type is known from WO 2008/025 555 A1. With this known apparatus, it is possible, with high stock removal rate and large removal surface, to mine rock or other hard materials economically, wherein the mill cutting or stock removal takes place radially outside the periphery of the tool drum. The known apparatus can advantageously be used to drive galleries or tunnels with the aid of part-face heading machines provided with an arm which is pivotable transversely to the main direction of advance and on the front end of which the tool drum is rotatably mounted. Such an apparatus can also be used, however, on mining machines for longwall-type extraction at the face.

In the known apparatus, it is also known to arrange the shaft axes of the tool carriers inclined by a few degrees in relation to the radial direction of the drum axis, whereby, when the apparatus is advanced in the axial direction of the tool drum, a good loosening result is achieved. It has been shown, however, that when the known apparatus is used on a machine extension arm which is pivoted from one side to the other and back, or else is moved back and forth by means of a mining machine at the face, no uniformly good mining result in both pivoting or motional directions is achieved, but rather the milling performance in one pivoting or motional direction of the machine extension arm or of the mining machine is better than in the opposite direction.

SUMMARY

The object of the invention is to rectify this situation and to offer a solution for an apparatus for the milling cutting of rock or the like of the type stated in the introduction, with which, irrespective of the motional direction of the tool drum, an equally good milling performance of the cutting tools mounted on the tool carriers is achieved.

This object is achieved with the invention by two tool drums arranged rotatably mounted side by side in twin arrangement on the drum holder, wherein the shaft axes of the tool carriers of the first tool drum span a first conical surface about the drum axis and the shaft axes of the tool carriers of the second tool drum span a second conical surface about the drum axis, the two conical surfaces being open to opposite sides.

As a result of the twin arrangement comprising two side-by-side tool drums, in which the axes of the tool carriers of one drum are inclined relative to the radial direction in one direction and the axes of the tool carriers of the other drum are inclined in the opposite direction, tools which are or can be optimally geared to the material to be cut and with which the material can be milled away with the same, high efficiency both in the forward and in the return motion, are provided for both pivoting motion directions of the machine extension arm. Through suitable positioning of the machine extension arm, it is here possible that it is only ever the tools of the tool spindles of one of the two tool drums which are engaged with the material to be extracted, whilst the tools on the other drum run freely and are only brought back into engagement with the face upon a change of direction of the machine extension arm.

Preferably, the two conical surfaces are oriented in mirror image or symmetrical to each other and have at least approximately the same included angle. In a particularly preferred embodiment of the invention, the arrangement is made such that the shaft axes of the tool carriers of the two tool drums are oriented such that they are mutually inclined in O-arrangement.

The two tool drums can be mounted on the drum holder at an axial distance apart which corresponds at least to the drum width of a tool drum. Due to the distance between the two tool drums, it is already possible by slight adjustment of the machine extension arm, upon a change of direction thereof, to disengage the previously working tools of one drum from the rock and to bring the tools of the other drum into operative engagement with the rock in order to mill this away when the apparatus is subsequently moved back.

It has proved particularly advantageous if the rotational direction of the tool carriers of the first tool drum is counter to the rotational direction of the tool carriers of the second tool drum. As a result of the different rotational directions, a milling result of the cutting tools which is equally good in both motional directions of the apparatus is obtained.

It is possible to assign to each tool carrier a dedicated drive. It has proved particularly advantageous, however, if the tool carriers of the first and/or second tool drum have a common drive. The arrangement can be made, for example, such that the common drive comprises a crown gear arranged concentrically to the drum axis, and respectively a bevel gear, which meshes with this crown gear, for each tool carrier of the first and/or second tool drum. In this design, it is possible for the crown gear to be arranged in a rotationally secure manner on the drum axis, whilst the tool drum rotates around the axis, whereby the tool carriers are set in rotation by the same drive as the respective tool drum and a fixed speed ratio between the speed of the tool drum and the speed of the tool carriers is obtained.

In this configuration, each tool carrier can be connected to a drive shaft, which at its other end supports the bevel gear. For a particularly stable configuration, the drive shaft can be in the form of a rigid shaft. It is also possible, however, to use an articulated shaft, preferably a Cardan shaft, which is of advantage, in particular, when the setting angle at which the tool carriers are inclined is intended to be variable.

The drive shafts are expediently accommodated in a protected manner inside the tool drum, whereby a premature wearing of gearwheels and bearings can be avoided. As already indicated, the tool drum and the tool carriers can be drivable by a common drive, wherein a design in which the crown gear of the bevel gear steps for the tool carriers is arranged on a common drive shaft with the sun wheel of a planetary gearing, via which the associated tool drum is driven, has proved particularly advantageous. In a particularly compact construction, this design allows maximum possible flexibility in the fixing of the speed ratios between the speed of the tool carriers and the speed of the tool drum(s) supporting these. It is also possible, however, that, though the tool carriers have a common drive, this is independent from a drive for the associated tool drum, whereby the rotational velocity of the tool carriers can be made particularly advantageously to be adjustable independently from the rotational velocity of the tool drum.

The included angles of the conical surfaces spanned by the shaft axes of the tool carriers can preferably be between ±3° and ±9°, measured relative to the radial direction of the tool drums.

The apparatus according to the invention can be used on a machine for longwall-type (face) extraction, or else can be used, particularly advantageously, also with part-face heading machines, for instance in order to drive drifts in underground mining or tunnelling.

BRIEF DESCRIPTION OF THE DRAWINGS

Further features and advantages of the invention emerge from the following description and the drawing, in which preferred embodiments of the invention are explained in greater detail on the basis of examples, wherein.

DETAILED DESCRIPTION

Figure 1:
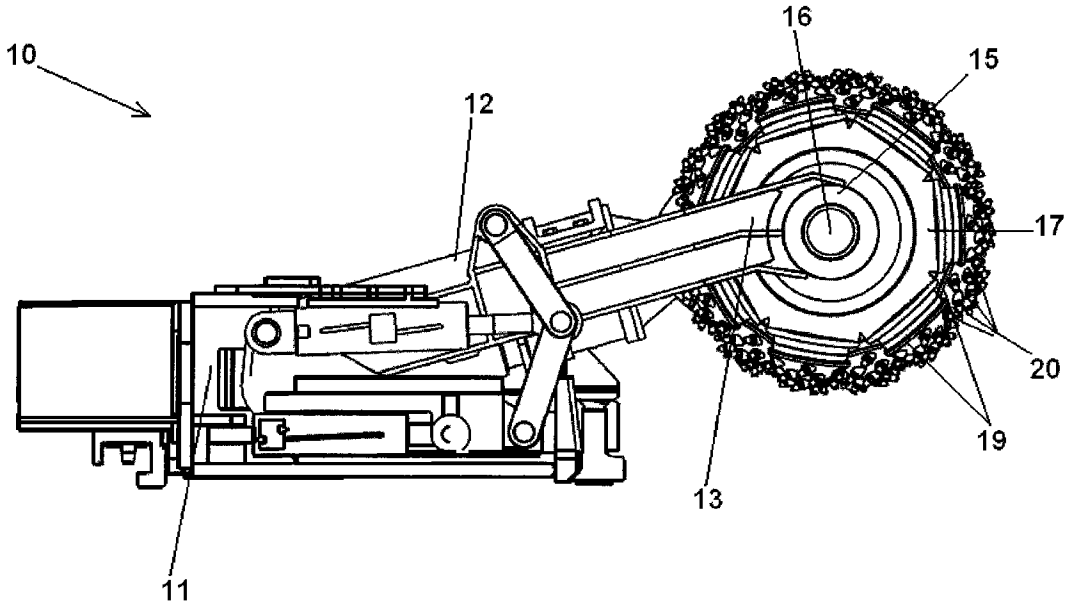
FIG. 1 shows a mining machine, equipped with a milling apparatus according to the invention, for longwall-type extraction in underground mining in a side view.

The mining machine which in FIG. 1 is denoted in its entirety as 10 can be used, for instance, in underground mining for the extraction of minerals in longwall mining, in which the machine is moved at the face along the stope and mills away the mineral to be extracted. The machine has a machine frame 11 having an extension arm 12, which is mounted thereon such that it can be pivoted and moved up and down and to the front end (pointing towards the working face) of which is attached a forked drum holder 13, which between its two fork ends 14, 15 receives a tool drum axle 16.

On the drum axle 16 received in a rotationally secure manner in the two fork ends 14, 15, two tool drums 17A, B are rotatably mounted side by side in twin arrangement, to be precise at such a distance apart that between them is accommodated a somewhat schematically represented drum drive 18, with which the tool drums 17 can be set in rotation in a manner which will be described in greater detail below.

Figure 2:
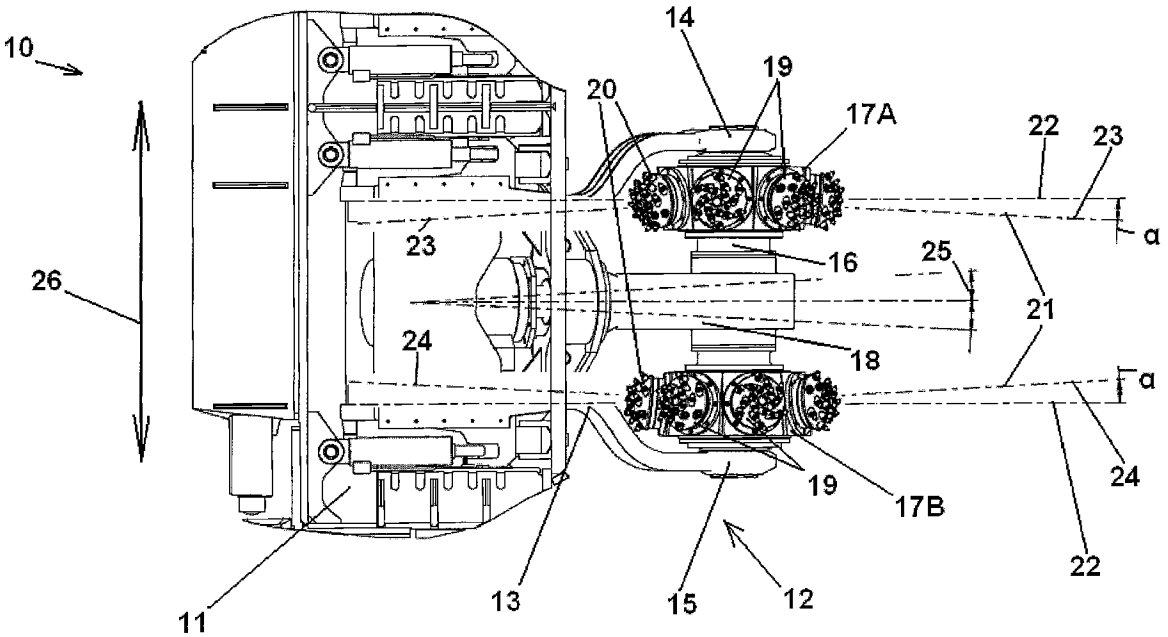
FIG. 2 shows the subject of FIG. 1 in a top view.

Each of the two tool drums 17 is provided with a plurality of tool carriers 19, which are arranged distributed over the periphery and carry cutting tools 20 for milling away the rock or the like. The tool carriers can be rotatingly driven, wherein their shaft axes 21 run substantially transversely to the drum axle 16. The arrangement is here made such that the shaft axes 21 of the tool carriers 19 of the two tool drums 17 are oriented inclined in relation to the radial direction 22 of the respective tool drum at an angle of about 6° inwards, i.e. in the direction of the respectively other tool drum, so that the shaft axes of the tool carriers of the first and second tool drum 17A, B span first and second conical surfaces 23, 24, which are oriented in mirror image to each other and are open towards each other at respectively the same included angle α, i.e., in similar fashion as with a spring-loaded adjusted anti-friction mounting, assume an 'O'-arrangement, which can be clearly seen in FIG. 2.

The mirror-image twin arrangement of two tool drums provided on their periphery with tool carriers allows particular efficiency in the mining progress, since namely each of the two tool drums, the tool carriers of which rotate about shaft axes inclined in relation to the radial direction, can be optimally matched to the either right-directed or left-directed direction of advance of the drum holder 13. As can be clearly seen at 25 in FIG. 2, the entire drum holder 13 can be pivoted by a setting angle of about ±6°. Given an appropriately positioned drum holder 13, the entire apparatus can be transported over its working range in the direction of the double arrow 26 in FIG. 2, wherein, in the case of a leftward running (in FIG. 2 upward running) working direction, the drum holder 13 is positioned to the left, so that the left-sided tool drum 17A is positioned a little way back and the right-sided tool drum 17B is positioned a little way forward and the tools of the left-sided tool drum 17A spin freely, whilst the tools on the right-sided tool drum 17B perform the milling work. Once the machine has reached its maximally desired travel distance, the drum holder is pivoted in the opposite direction, whereby the tool drum 17B which is then, in the following milling operation, situated at the front (at the bottom in FIG. 2), or the tools which are fitted to this tool drum, are disengaged from the rock, whilst the tools on the left-sided drum 17A mill cut into the rock and then, in the return travel of the apparatus, perform the milling work.

Figure 3:
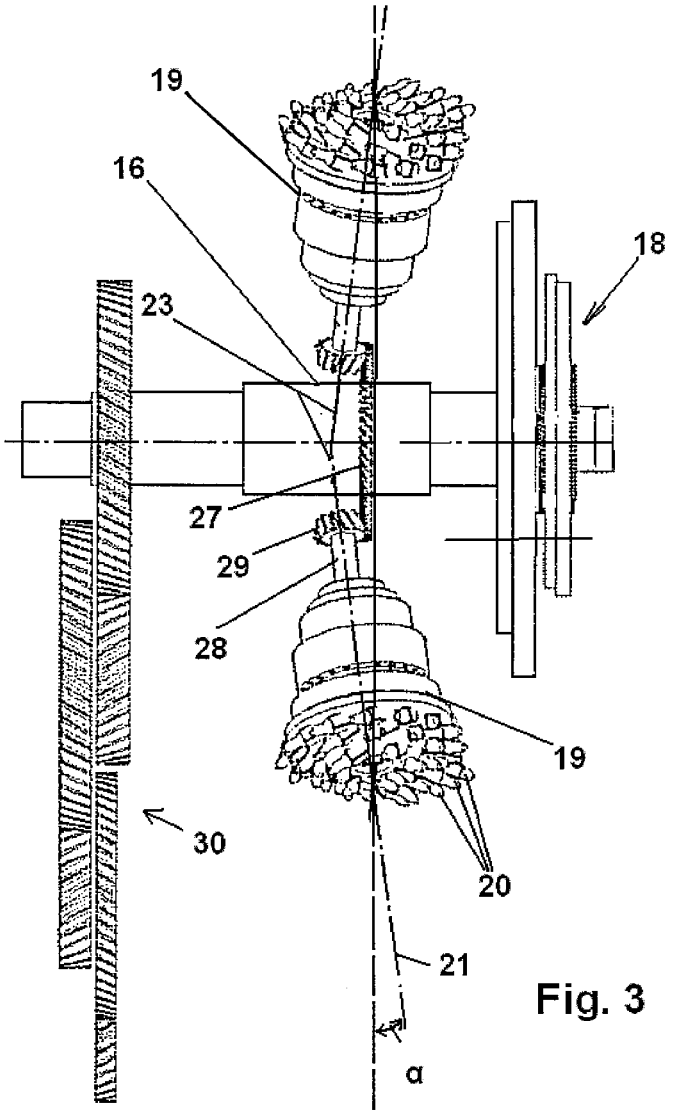
FIG. 3 shows a common drive for the tool carriers of one of the two tool drums of the apparatus according to the invention in a top view.

FIG. 3 shows the drive of the tool carriers 19 on one of the two tool drums 17, wherein the drive for the tool carriers on the other tool drum is identically configured in mirror image and is not represented in detail here.

It can be seen that the tool carriers 19 in the tool drum are provided with a common drive, to which a crown gear 27 which is arranged concentrically to the drum axle 16 and is mounted fixedly on the drum axle 16 belongs. Each tool carrier 19 is connected to a drive shaft 28, which at its other, radially inner end supports a bevel gear 29 which meshes with the toothing on the crown gear 27. The entire common drive is accommodated inside the tool drum (not jointly represented in FIG. 3) and is hereby protected from the influx of dust, moisture and the like. When the tool drums 17 are set in rotation by the drum drive 18 (FIG. 2) via the spur gear 30 represented schematically in FIG. 3, a relative rotation of the drums in relation to the crown gear 27 mounted in their interior fixedly on the drum axis comes about. Since the tool carriers rotatably mounted on the periphery of the tool drum, upon the rotation of the drum, are taken along by this, they are set in rotation by the rigidly fixed crown gear via the bevel gear steps 27, 29, wherein, owing to the mirror-image arrangement of the two tool drums, the tool carriers on the two tool drums rotate counter to each other. The speed ratio between the speed of the tool drums and the speed of the tool carriers is here constant and is determined by the transmission ratio of the bevel gear steps 27, 29.

The invention is not limited to the represented and described illustrative embodiments, but rather various modifications and additions are possible without departing from the scope of the invention. Thus it is possible, for instance, for the rotary drive of the tool carriers, to assign to each of these a separate drive, or a common drive for all tool carriers of a tool drum may be provided, which common drive, however, is decoupled from the rotary drive for the drum. Self-evidently, the apparatus according to the invention can be used not only on mining machines, but particularly advantageously also on part-face heading machines or the like, as are used in underground mining for the driving of drifts or in tunnelling.

The invention claimed is:

1. An apparatus for the milling cutting of rock, minerals or other hard materials, comprising:

a drum holder operable to pivot through a setting angle;

a first tool drum mounted on the drum holder and being rotatably drivable about a drum axis, the first tool drum comprising a plurality of tool carriers supporting cutting tools and being arranged distributed over the periphery of the first tool drum, the plurality of tool carriers of the first tool drum having shaft axes running transversely to the drum axis;

a second tool drum arranged rotatably mounted side by side with respect to the first tool drum in a twin arrangement on the drum holder and being rotatably driven about the drum axis, the second tool drum comprising a plurality of tool carriers supporting cutting tools and being arranged distributed over the periphery of the second tool drum, the plurality of tool carriers of the second tool drum having shaft axes running transversely to the drum axis; and drive gears configured to rotate the tool carriers of the first tool drum in a direction counter to the rotational direction of the tool carriers of the second tool drum, wherein the shaft axes of the plurality of tool carriers of the first tool drum span a first conical surface about the drum axis and the shaft axes of the plurality of tool carriers of the second tool drum span a second conical surface about the drum axis, the first and second conical surfaces being open to opposite sides;

so that when the drum carrier is pivoted toward the first side, the first tool drum is positioned rearward of the second tool drum with the first tool drum configured to spin freely and the second tool drum configured to conduct the milling, and when the drum carrier is pivoted toward the second side, the second tool drum is positioned rearward of the first tool drum with the second tool drum configured to spin freely and the first tool drum configured to conduct the milling.

2. The apparatus according to claim 1, wherein the first and second conical surfaces are oriented in mirror image to each other and have at least approximately a common included angle ($\alpha$).

3. The apparatus according to claim 2, wherein the shaft axes of the plurality of tool carriers of each of the first and second tool drums are oriented such that they are mutually inclined in O-arrangement.

4. The apparatus according to claim 3, wherein the first and second tool drums are mounted on the drum carrier at an axial distance apart which corresponds at least to a width of the first tool drum or the second tool drum.

5. The apparatus according to claim 2, wherein included angles ($\alpha$) of the conical surfaces spanned by the shaft axes of the plurality of tool carriers are between ±3° and ±9°, measured relative to a radial direction of the first and second tool drums.

6. The apparatus according to claim 1, wherein the plurality of tool carriers of at least one of the first and second tool drums have a common drive.

7. The apparatus according to claim 6, wherein the common drive comprises at least one crown gear arranged concentrically to the drum axis, and a bevel gear which meshes with the crown gear, for each tool carrier of the at least one of the first and second tool drum.

8. The apparatus according to claim 7, wherein each tool carrier is connected to a drive shaft at a first end, the drive shaft having a second end which supports the bevel gear.

9. The apparatus according to claim 8, wherein the drive shaft is one of a rigid shaft or an articulated shaft.

10. The apparatus according to claim 8, wherein the drive shaft comprises a Cardan shaft.

11. The apparatus according to claim 8, wherein each drive shaft is disposed inside the tool drums.

12. The apparatus according to claim 1, wherein the first and second tool drums and the plurality of tool carriers are driven by a common drive.

13. The apparatus according to claim 1, wherein each of the plurality of tool carriers have a common drive, which is independent from a drive for the first and second tool drums.

14. The apparatus according to claim 13, wherein a rotational velocity of the plurality of tool carriers is adjustable independently from a rotational velocity of the tool drums.

15. An apparatus for the milling cutting of rock, minerals or other hard materials, comprising:

a frame;

a drum holder pivotally coupled to the frame;

a first tool drum mounted on the drum holder and being rotatably drivable about a drum axis, the first tool drum comprising a plurality of tool carriers supporting cutting tools and being arranged distributed over the periphery of the first tool drum, the plurality of tool carriers of the first tool drum having shaft axes running transversely to the drum axis, the first tool drum disposed proximate a first side of the drum holder;

a second tool drum arranged rotatably mounted side by side with respect to the first tool drum in twin arrangement on the drum holder and being rotatably driveable about the drum axis, the second tool drum comprising a plurality of tool carriers supporting cutting tools and being arranged distributed over the periphery of the second tool drum, the plurality of tool carriers of the second tool drum having shaft axes running transversely to the drum axis, the second tool drum disposed proximate a second side of the drum holder; and drive gears configured to rotate the tool carriers of the first tool drum in a direction counter to the rotational direction of the tool carriers of the second tool drum;

wherein the shaft axes of the plurality of tool carriers of the first tool drum are angularly offset from the drum axis at a first non-perpendicular angle, and the shaft axes of the plurality of tool carriers of the second tool drum are angularly offset from the drum axis at a second non-perpendicular angle, and the first and second non-perpendicular angles being substantially equal and opposite to each other; so that when the drum carrier is pivoted toward the first side, the first tool drum is positioned rearward of the second tool drum with the first tool drum configured to spin freely and the second tool drum configured to conduct the milling, and when the drum carrier is pivoted toward the second side, the second tool drum is positioned rearward of the first tool drum with the second tool drum configured to spin freely and the first tool drum configured to conduct the milling.

16. The apparatus according to claim 15, wherein the plurality of tool carriers of the first and second tool drums have a common drive, and the common drive comprises at least one crown gear arranged concentrically to the drum axis, and a bevel gear which meshes with the crown gear, for each tool carrier of the first and second tool drum.

17. The apparatus according to claim 16, wherein each tool carrier is connected to a drive shaft at a first end, the drive shaft having a second end which supports the bevel gear.

* * * * *